US006283178B1

(12) United States Patent
Way

(10) Patent No.: US 6,283,178 B1
(45) Date of Patent: Sep. 4, 2001

(54) BAG FILLER ATTACHMENT FOR A SANDER

(76) Inventor: Leonard Way, 2062 Range Trail, Verona, WI (US) 53593

( * ) Notice: Subject to any disclaimer, the term of this patent is extended or adjusted under 35 U.S.C. 154(b) by 0 days.

(21) Appl. No.: 09/497,926

(22) Filed: Feb. 4, 2000

(51) Int. Cl.[7] ..... B65B 1/04

(52) U.S. Cl. ..... 141/316; 141/231; 222/460; 222/608

(58) Field of Search ..... 141/313–317, 141/231; 222/460–462, 608

(56) References Cited

U.S. PATENT DOCUMENTS

| | | | | |
|---|---|---|---|---|
| 617,961 | * | 1/1899 | Johnson | 141/314 |
| 640,785 | * | 1/1900 | Marshall | 141/313 |
| 862,231 | * | 8/1907 | Bates | 141/314 |
| 1,003,006 | * | 9/1911 | Maxwell | 141/316 |
| 1,132,600 | * | 3/1915 | Moore | 141/314 |
| 3,516,454 | * | 6/1970 | Smith | 141/317 |
| 4,139,029 | * | 2/1979 | Geraci | 141/313 |
| 5,297,598 | * | 3/1994 | Rasmussen | 141/314 |
| 5,603,361 | * | 2/1997 | Cuisinier | 141/313 |
| 5,771,665 | * | 6/1998 | Nelson et al. | 53/459 |
| 5,873,396 | * | 2/1999 | Biebrach et al. | 141/231 |

* cited by examiner

*Primary Examiner*—J. Casimer Jacyna

(57) ABSTRACT

A bag filler attachment for a sander for quickly and conveniently filling large number of bags. The bag filler attachment for a sander includes a hopper member having a top end, bottom portion, top portion which is tapered from the top end to the bottom portion, a flange member securely attached along a rim of the hopper member at the top end thereof and being attachable to a dispensing member on a sander; and also includes a bag holding member which includes an elongate member being securely attached to the bottom portion and being horizontally disposed and having a pair laterally-extending grooves extending about the circumference of the elongate member near the ends thereof and being adapted to hold one end of a bag during the filling thereof.

12 Claims, 2 Drawing Sheets

BAG FILLER ATTACHMENT FOR A SANDER

BACKGROUND OF THE INVENTION

1. Field of the Invention

The present invention relates to an accessory for filling bags with sand and more particularly pertains to a new bag filler attachment for a sander for quickly and conveniently filling large number of bags.

2. Description of the Prior Art

The use of accessory for filling bags with sand is known in the prior art. More specifically, accessory for filling bags with sand heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,758,764; U.S. Pat. No. 4,672,901; U.S. Pat. No. 5,425,403; U.S. Pat. No. 4,325,418; U.S. Pat. No. 3,369,577; and U.S. Pat. No. Des. 158,693.

While these devices fulfill their respective, particular objectives and requirements, the aforementioned patents do not disclose a new bag filler attachment for a sander. The inventive device includes a hopper member having a top end, bottom portion, top portion which is tapered from the top end to the bottom portion, a flange member securely attached along a rim of the hopper member at the top end thereof and being attachable to a dispensing member on a sander; and also includes a bag holding member which includes an elongate member being securely attached to the bottom portion and being horizontally disposed and having a pair laterally-extending grooves extending about the circumference of the elongate member near the ends thereof and being adapted to hold one end of a bag during the filling thereof.

In these respects, the bag filler attachment for a sander according to the present invention substantially departs from the conventional concepts and designs of the prior art, and in so doing provides an apparatus primarily developed for the purpose of quickly and conveniently filling large number of bags.

SUMMARY OF THE INVENTION

In view of the foregoing disadvantages inherent in the known types of accessory for filling bags with sand now present in the prior art, the present invention provides a new bag filler attachment for a sander construction wherein the same can be utilized for quickly and conveniently filling large number of bags.

The general purpose of the present invention, which will be described subsequently in greater detail, is to provide a new bag filler attachment for a sander which has many of the advantages of the accessory for filling bags with sand mentioned heretofore and many novel features that result in a new bag filler attachment for a sander which is not anticipated, rendered obvious, suggested, or even implied by any of the prior art accessory for filling bags with sand, either alone or in any combination thereof.

To attain this, the present invention generally comprises a hopper member having a top end, bottom portion, top portion which is tapered from the top end to the bottom portion, a flange member securely attached along a rim of the hopper member at the top end thereof and being attachable to a dispensing member on a sander; and also includes a bag holding member which includes an elongate member being securely attached to the bottom portion and being horizontally disposed and having a pair laterally-extending grooves extending about the circumference of the elongate member near the ends thereof and being adapted to hold one end of a bag during the filling thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bag filler attachment for a sander which has many of the advantages of the accessory for filling bags with sand mentioned heretofore and many novel features that result in a new bag filler attachment for a sander which is not anticipated, rendered obvious, suggested, or even implied by any of the prior art accessory for filling bags with sand, either alone or in any combination thereof.

It is another object of the present invention to provide a new bag filler attachment for a sander which may be easily and efficiently manufactured and marketed.

It is a further object of the present invention to provide a new bag filler attachment for a sander which is of a durable and reliable construction.

An even further object of the present invention is to provide a new bag filler attachment for a sander which is susceptible of a low cost of manufacture with regard to both materials and labor, and which accordingly is then susceptible of low prices of sale to the consuming public, thereby making such bag filler attachment for a sander economically available to the buying public.

Still yet another object of the present invention is to provide a new bag filler attachment for a sander which provides in the apparatuses and methods of the prior art some of the advantages thereof, while simultaneously overcoming some of the disadvantages normally associated therewith.

Still another object of the present invention is to provide a new bag filler attachment for a sander for quickly and conveniently filling large number of bags.

Yet another object of the present invention is to provide a new bag filler attachment for a sander which includes a hopper member having a top end, bottom portion, top portion which is tapered from the top end to the bottom portion, a flange member securely attached along a rim of the hopper member at the top end thereof and being attachable to a dispensing member on a sander; and also includes a bag holding member which includes an elongate member being securely attached to the bottom portion and being horizontally disposed and having a pair laterally-extending grooves extending about the circumference of the elongate member near the ends thereof and being adapted to hold one end of a bag during the filling thereof.

Still yet another object of the present invention is to provide a new bag filler attachment for a sander that allows the user to easily fill a large number of bags within a very short period of time.

Even still another object of the present invention is to provide a new bag filler attachment for a sander that eliminates the need of having two or more people fill simply one bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
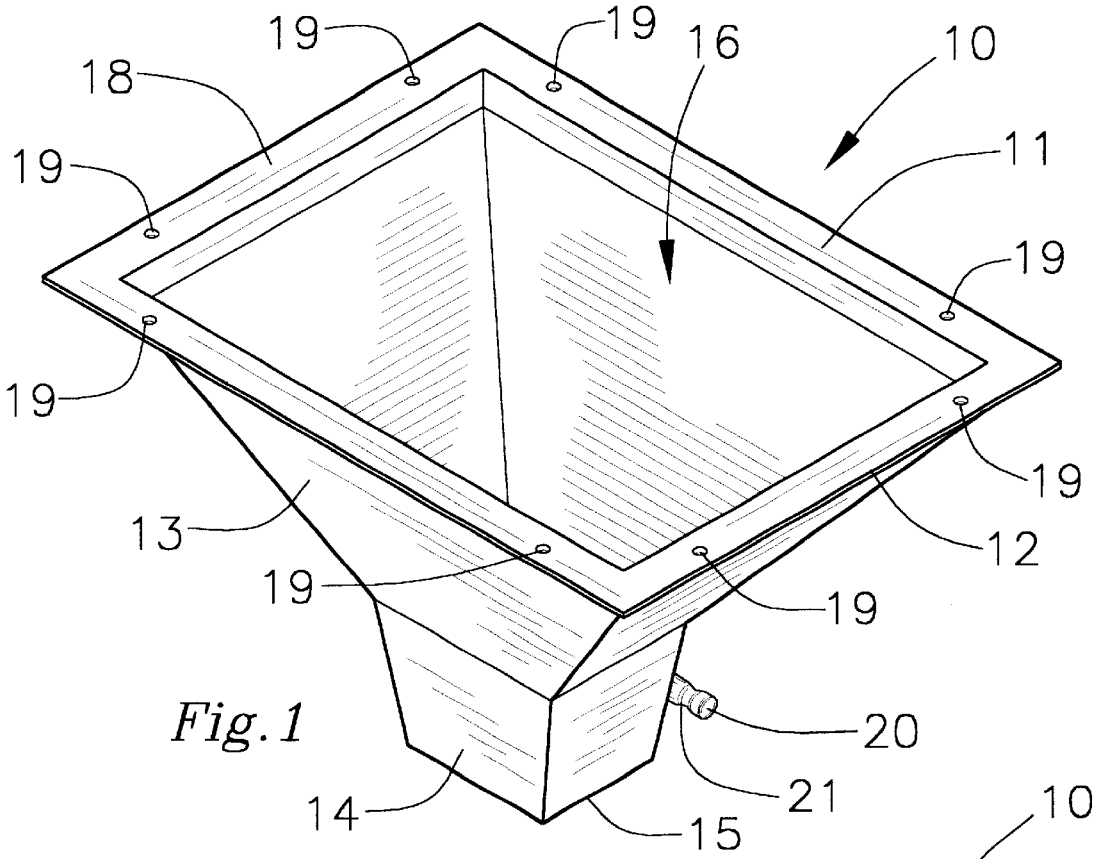
FIG. 1 is a top perspective view of a new bag filler attachment for a sander according to the present invention.
Figure 2:
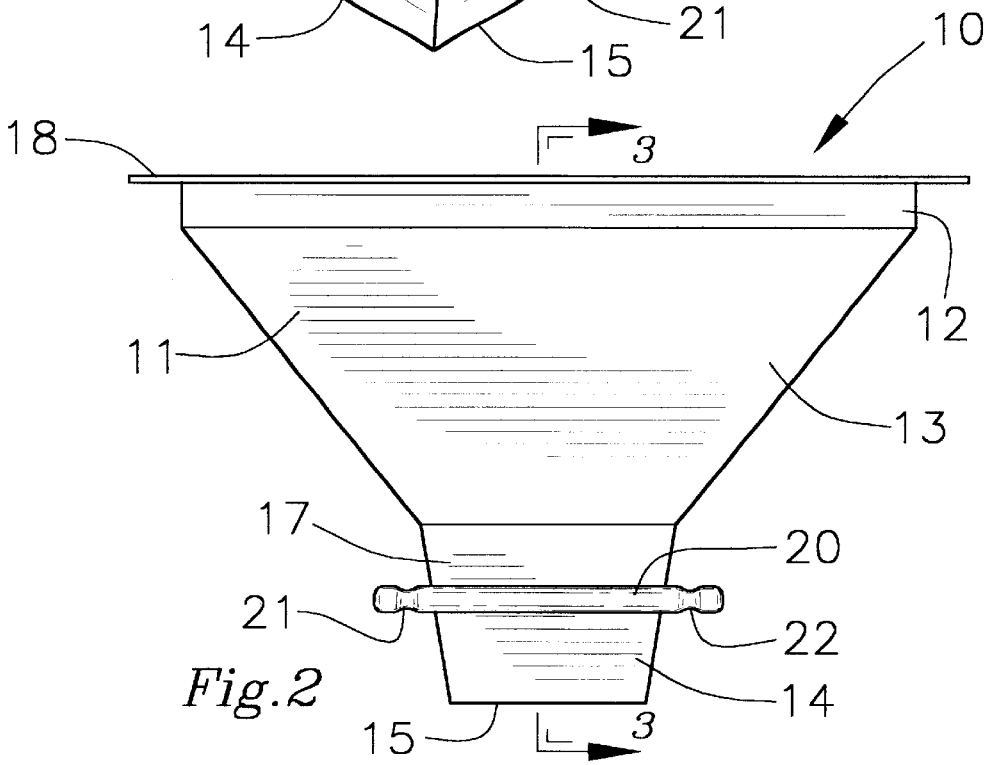
FIG. 2 is one side elevational view of the present invention.
Figure 3:
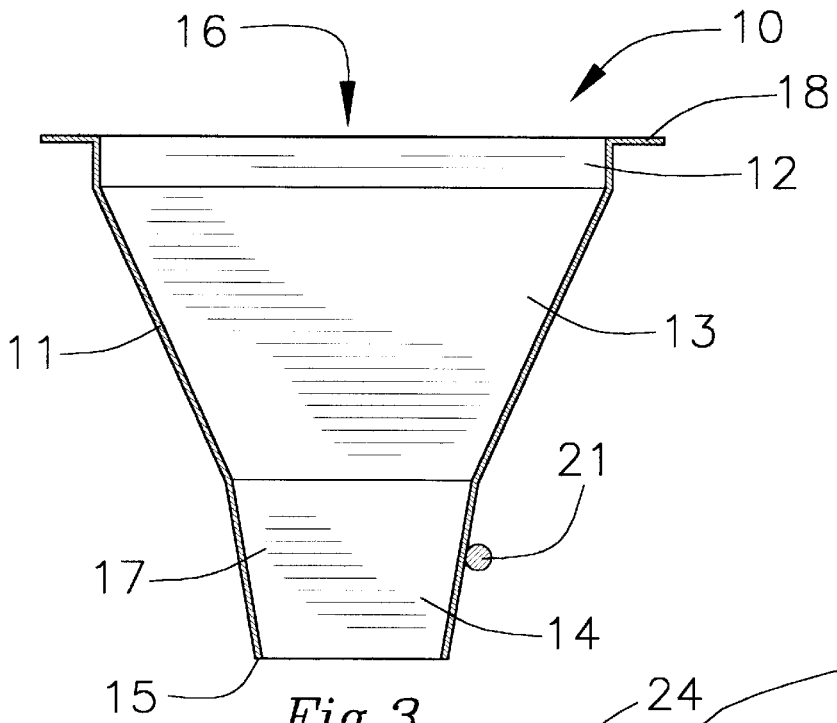
FIG. 3 is another side elevational view of the present invention.
Figure 4:
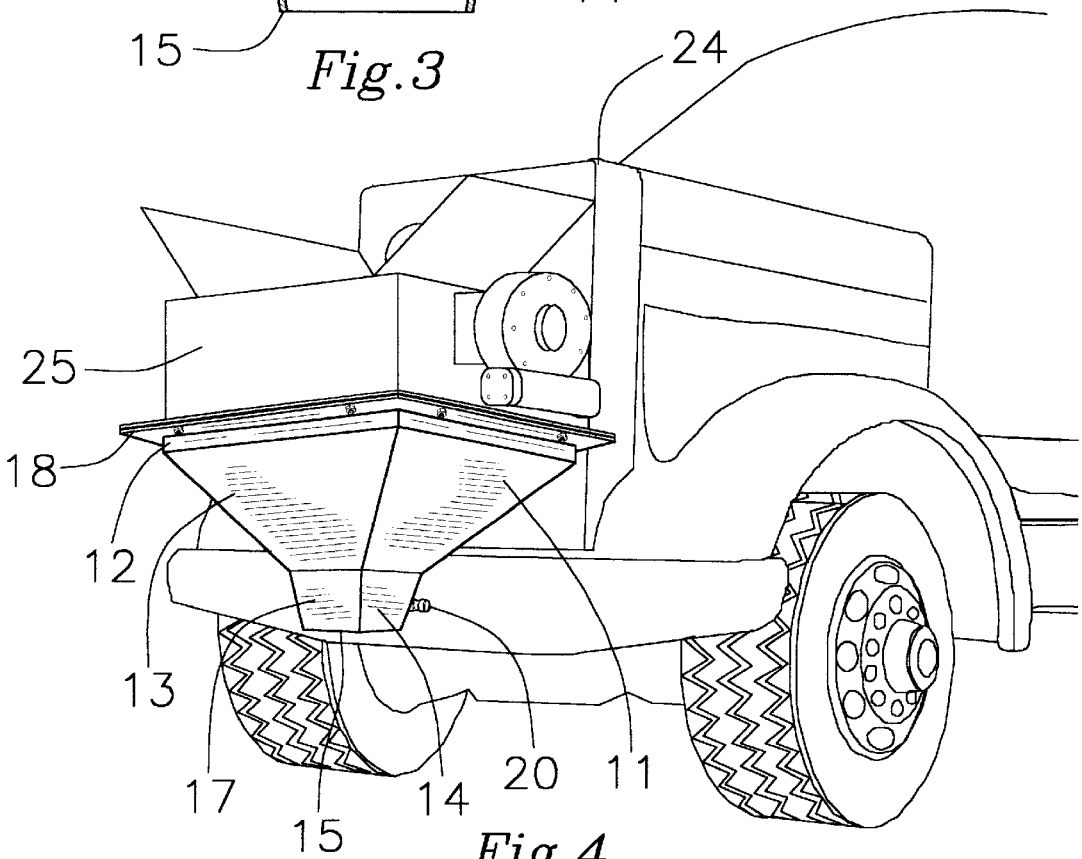
FIG. 4 is a perspective view of the present invention mounted to sander.

With reference now to the drawings, and in particular to FIGS. 1 through 4 thereof, a new bag filler attachment for a sander embodying the principles and concepts of the present invention and generally designated by the reference numeral 10 will be described.

As best illustrated in FIGS. 1 through 4, the bag filler attachment for a sander 10 generally comprises a hopper member 11 having a top end 12, a top portion 13, a bottom portion 14, a bottom end 15, a bore 16 extending therethrough from the top end 12 to the bottom end 15, and a flange member 18 securely and conventionally attached or welded along a rim of the top end 12 of the hopper member 11 and extending outwardly therefrom. The flange member 18 has a plurality of holes 19 spaced therealong and extending therethrough and being adapted to be mounted to a sander. The top portion 13 of the hopper member 11 is tapered from the top end 12 to the bottom portion 14. The bottom portion 14 of the hopper member 11 is essentially a chute through which filler material such as sand is passed into a bag during the filling thereof. The chute has side walls 17 with the hopper member 11 having a height of approximately 18 inches. A bag holding member is securely and conventionally mounted to one of the side walls 17 of the hopper member 11 and is adapted to hold a bag during the filling thereof and includes an elongate member 20 which is securely attached or welded to an exterior of one of the side walls 17 of the chute and has a side wall. The elongate member 20 is disposed generally parallel to the top end 12 and the bottom end 15 of the hopper member 11 and includes a pair of laterally-extending grooves 21,22 extending in the side wall. Each of the grooves 21,22 is disposed near a respective end of the elongate member 20 with each of the grooves 21,22 extending about a circumference of the elongate member 20. The elongate member 20 is essentially cylindrical-shaped with the ends of the elongate member 20 extending outwardly beyond the sides of the bottom portion 14 of the hopper member 11 and being adapted to receive a bag looped over the grooves 21,22 of the elongate member 11. The elongate member 20 has a diameter of approximately ¾ inches.

In use, the hopper member 11 is fastened to a dispensing member 25 of a sander 24 with bolts or fasteners inserted through the holes 19 in the flange member 18, and one end of a bag is secured about the ends of the elongate member 20 and held in place by the grooves 21,22 with the user holding the other end of the bag on the other side of the hopper member 11 with the open end of the bag being disposed beneath the bottom end 15 of the hopper member 11. Once the bag is filled, the user then removes the bag from the ends of the elongate member 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A bag filler attachment for a sander comprising:

a hopper member having a top end, a top portion, a bottom portion, a bottom end, a bore extending therethrough from said top end to said bottom end, and a flange member securely attached along a rim of said top end of said hopper member and extending outwardly therefrom, said flange member having a plurality of holes spaced therealong and extending therethrough and being adapted to be mounted to a sander, said bottom portion of said hopper member comprises a chute having side walls through which filler material is passed into a bag during the filling thereof; and a bag holding member being securely mounted to one of said side walls of said hopper member and being adapted to hold a bag during a filling thereof;

wherein said top portion of said hopper member is tapered from said top end to said bottom portion;

wherein said bag holding member includes an elongate member being securely attached to an exterior of one of said side walls of said chute and having at least one side wall;

wherein said elongate member is disposed generally parallel to said top end and said bottom end of said hopper member; and wherein said elongate member includes a pair of laterally extending grooves extending in said at least one side wall, each of said grooves being near a respective end of said elongate member.

2. A bag filler attachment for a sander as described in claim 1, wherein each of said grooves extends about a circumference of said elongate member.

3. A bag filler attachment for a sander as described in claim 1, wherein said elongate member is essentially cylindrical-shaped.

4. A bag filler attachment for a sander as described in claim 1, wherein said ends of said elongate member extends outwardly beyond sides of said bottom portion of said hopper member and being adapted to receive an end of a bag looped about said grooves.

5. A bag filler attachment for a sander comprising:

a hopper member having a top end, a top portion, a bottom portion, a bottom end, a bore extending therethrough from said top end to said bottom end, and a flange member securely attached along a rim of said top end of said hopper member and extending outwardly therefrom, said flange member having a plurality of holes spaced therealong and extending therethrough and being adapted to be mounted to a sander, said top portion of said hopper member being tapered from said top end to said bottom portion, said bottom portion of said hopper member being essentially a chute through which filler material is passed into a bag during the filling thereof, said chute having side walls, said hopper member having a height of approximately 18 inches; and a bag holding member being securely mounted to one of said side walls of said hopper member and being adapted to hold a bag during a filling thereof, said bag holding member comprising an elongate member being securely attached to an exterior of one of said side walls of said chute and having at least one side wall, said elongate member is disposed generally parallel to said top end and said bottom end of said hopper member, said elongate member including a pair of laterally-extending grooves extending in said at least one side wall, each of said grooves being near a respective end of said elongate member, each of said grooves extending about a circumference of said elongate member, said elongate member being essentially cylindrical-shaped, said ends of said elongate member extending outwardly beyond sides of said bottom portion of said hopper member and being adapted to receive an end of a bag looped over said grooves of said elongate member, said elongate member having a diameter of approximately ¾ inches.

6. A bag filler attachment for a sander comprising:

a hopper member having a top end, a top portion, a bottom portion, a bottom end, a bore extending therethrough from said top end to said bottom end, said bottom portion of said hopper member is essentially a chute through which filler material is passed into a bag during the filling thereof, said chute having side walls; and a bag holding member mounted to only one of said side walls of said hopper member and being adapted to hold a bag during a filling thereof, said bag holding member comprising an elongate member mounted on an exterior of only one of said side walls of said chute, said elongate member being disposed generally parallel to said top end said bottom end and only one of said side walls of said hopper member, said elongate member having both end portions extending outwardly beyond both side edges of said one of said side walls of said bottom portion of said hopper member.

7. A bag filler attachment for a sander as described in claim 6, wherein said elongate member includes a pair of laterally-extending grooves extending in said at least one side wall, each of said grooves being formed in a respective end portion of said elongate member.

8. A bag filler attachment for a sander as described in claim 7, wherein each of said grooves extends about a circumference of said elongate member for looping an end of a bag about said grooves.

9. A bag filler attachment for a sander as described in claim 6, wherein said top portion of said hopper member is tapered from said top end to said bottom portion.

10. A bag filler attachment for a sander as described in claim 6, wherein said elongate member is essentially cylindrical-shaped.

11. A bag filler attachment for a sander as described in claim 6 additionally comprising a flange member mounted along a rim of said top end of said hopper member and extending outwardly therefrom.

12. A bag filler attachment for a sander as described in claim 11, said flange member having a plurality of holes spaced therealong and extending therethrough and being adapted to be mounted to a sander.

* * * * *